US010267035B2

(12) United States Patent
Schreck

(10) Patent No.: US 10,267,035 B2
(45) Date of Patent: Apr. 23, 2019

(54) MODULAR SYSTEM

(71) Applicant: Hans Schreck, Burgwald-Bottendorf (DE)

(72) Inventor: Hans Schreck, Burgwald-Bottendorf (DE)

( * ) Notice: Subject to any disclaimer, the term of this patent is extended or adjusted under 35 U.S.C. 154(b) by 0 days.

(21) Appl. No.: 15/524,359

(22) PCT Filed: Nov. 13, 2015

(86) PCT No.: PCT/EP2015/076555
§ 371 (c)(1),
(2) Date: May 4, 2017

(87) PCT Pub. No.: WO2016/079020
PCT Pub. Date: May 26, 2016

(65) Prior Publication Data

US 2018/0274230 A1 Sep. 27, 2018

(30) Foreign Application Priority Data

Nov. 18, 2014 (DE) ..... 10 2014 223 521

(51) Int. Cl.
*E04B 2/00* (2006.01)
*E04B 2/74* (2006.01)
(Continued)

(52) U.S. Cl.
CPC ..... *E04B 2/7405* (2013.01); *A47B 47/0033* (2013.01); *A47B 47/0091* (2013.01);
(Continued)

(58) Field of Classification Search
CPC ..... A47B 47/0033; A47B 47/0091; A47B 2220/0036; E04B 2/7405; E04F 15/02452
See application file for complete search history.

(56) References Cited

U.S. PATENT DOCUMENTS 4,515,280 A * 5/1985 Sheu ..... A47B 47/0033 108/180
4,736,555 A * 4/1988 Nagare ..... E04F 15/02452 248/544
(Continued)

FOREIGN PATENT DOCUMENTS

CN 102231998 A 11/2011
CN 103061475 A 4/2013
(Continued)

*Primary Examiner* — Brian D Mattei
(74) *Attorney, Agent, or Firm* — King & Schickli, PLLC

(57) ABSTRACT

The invention relates to a modular system (10) for structuring or shaping spaces, surfaces, or the like, comprising a component assembly, which comprises at least two modular elements (12) and at least one connecting element (14, 15, 16), said modular element being designed as a box-shaped body, whose base has at least three corners, each corner forming a connecting structure for connecting the modular element to a connecting element, said connecting structure being designed as an arc-shaped contour of the corner together with a void adjacent to the contour, said connecting element forming a pin for each of the connecting structures to be connected, said pin being designed congruent with the void and in such a manner that the pin can be interlockingly inserted into the void, said connecting element forming a positioning device for positioning the connecting element on the modular element, said positioning device comprising an axis, said axis being designed congruent with the contour and in such a manner that the axis can be arranged on the contour.

20 Claims, 11 Drawing Sheets

(51) Int. Cl.

| | |
|---|---|
| ***E04B 1/61*** | (2006.01) |
| ***A47B 47/00*** | (2006.01) |
| *A47B 87/02* | (2006.01) |
| *E04B 1/32* | (2006.01) |

(52) U.S. Cl.
CPC ..... *E04B 1/6116* (2013.01); *E04B 1/6162* (2013.01); *A47B 87/0292* (2013.01); *A47B 2220/0036* (2013.01); *E04B 1/61* (2013.01); *E04B 2/7401* (2013.01); *E04B 2001/3282* (2013.01); *E04B 2001/6191* (2013.01)

(56) References Cited

U.S. PATENT DOCUMENTS

| | | | | |
|---|---|---|---|---|
| 4,901,490 | A * | 2/1990 | Zinniel | E04F 15/02405 248/346.5 |
| 4,996,804 | A | 3/1991 | Naka et al. | |
| 5,333,423 | A * | 8/1994 | Propst | E04F 15/02476 248/188 |
| 5,459,968 | A * | 10/1995 | Jin | E04F 15/02476 52/126.2 |
| 5,732,518 | A | 3/1998 | Roberts | |
| 7,980,040 | B2 * | 7/2011 | Pacione | A47G 27/0468 52/584.1 |
| 2003/0192271 | A1 * | 10/2003 | Koutras | E04B 2/7405 52/285.1 |
| 2005/0005547 | A1 | 1/2005 | Mead | |
| 2014/0069882 | A1 * | 3/2014 | Cheng | A47F 5/0018 211/150 |
| 2014/0197123 | A1 * | 7/2014 | McPhillips | G09F 15/00 211/195 |
| 2016/0330862 | A1 * | 11/2016 | Pace | F16M 13/00 |

FOREIGN PATENT DOCUMENTS

| | | |
|---|---|---|
| DE | 2326429 A1 | 11/1974 |
| GB | 2482599 | 8/2012 |

* cited by examiner 86
31
90
83
87
32
88

33
34

35
36

MODULAR SYSTEM

FIELD OF THE INVENTION

The invention relates to a modular system for structuring or designing spaces, surfaces or the like, comprising a component assembly, comprising at least two modular elements and at least one connecting element, said modular element being designed as a box-shaped body, whose base comprises at least three corners, each corner forming a connecting structure for connecting the modular element to the connecting element.

BACKGROUND OF THE INVENTION

A series of such modular systems is known from the state of the art, by means of which spaces can be structured, designed or decorated. These modular systems generally comprise a plurality of modular elements, which can be connected to one another in one manner or another. These modular elements can be set up to form, for example, dividers, partitions, suspended ceilings, lamp shades or other elements for designing spaces.

A modular system is known from DE 2 326 429, for example, in which a modular element is formed from two box-shaped bodies, which can be connected to one another. The modular element, in turn, can be connected to form further modular elements via external connecting structures formed on the modular element such that a wall is formed.

Moreover, modular systems are known, whose modular elements can be connected by means of a connecting element, such as a screw. Respective connecting structures can then be formed at corners of the modular elements, which allow screwing the modular elements directly to one another. A reliable connection between the modular elements can be realized by screwing the modular elements to one another, however, installing the modular elements remains elaborate since they have to be exactly positioned to one another so that the screw, for example, can be inserted through the corresponding connecting structure and be screwed in place. This is complicated in particular by the fact that should the modular elements be made of a plastic material, for example, the modular elements can comprise large dimensional tolerances, which are caused by a demolding process, by what means the corresponding connecting structures may not align in the manner required for screwing the modular elements in place. Depending on how the modular elements are formed, and in particular when the body is designed in the shape of a box, the modular elements regularly comprise deforming slopes, which may complicate a required relative positioning of the modular elements regarding installation.

SUMMARY OF THE INVENTION

The object of invention at hand is therefore to propose a modular system, which enables a simplified though secure installation of modular elements and simultaneously provides multiple possibilities for producing a modular system product.

This object is attained by a modular system comprising the features of claim 1 and a modular system product comprising the features of claim 20.

The modular system according to the invention for structuring or shaping spaces, surfaces, or the like, comprises a component assembly, which comprises at least two modular elements and at least one connecting element, said modular element being designed as a box-shaped body, whose base has at least three corners, each corner forming a connecting structure for connecting the modular element to a connecting element, said connecting structure being designed as an arc-shaped contour of the corner together with a void adjacent to the contour, said connecting element forming a pin for each of the connecting structures to be connected, said pin being designed congruent with the void and in such a manner that the pin can be interlockingly inserted into the void, said connecting element forming a positioning device for positioning the connecting element on the modular element, said positioning device comprising an axis, said axis being designed congruent with the contour and in such a manner that the axis can be arranged on the contour.

The connecting structure for connecting to a connecting structure of a directly adjacent modular element is formed at the corresponding ends or rather corners of the essentially flat base of the box-shaped body. The actual connection takes place via the connecting element, which can be interlockingly inserted into the corresponding connecting structures. For connecting two modular elements, the connecting element either forms two pins or comprises these, said pins being able to be interlockingly inserted into the void of the connecting structure, which can be through openings or blind holes. The pins are aligned relatively parallel to one another so that the modular element can be arranged at a relative distance advantageous for installation. Since the pins can be formed not only angular but also round, there is a potential risk of the modular elements twisting relative to one another around the corresponding pin. This is effectively prevented by the positioning device of the connecting element, which is formed as an axis. The axis can be adjusted to the arc-shaped contour of the corresponding corners or connecting structures, respectively, such that the modular elements can no longer be moved relative to one another. Each connecting structure of a modular element is then interlockingly connected to the pin and rests against the axis comprising the arc-shaped contour in a supplementary manner. The axis is thus always arranged between two connecting structures and either aligns or centers the connecting structures relative to one another. For installing a modular system product, it is necessary to only roughly position the modular elements relative to one another and to achieve an interlocking connection by inserting the connecting element into the corresponding connecting structure, said interlocking connection enabling the desired and exact relative positioning via the corresponding geometric shapes of the connecting structures and the connecting element. It is thus possible to form a sophisticated modular system product from a plurality of modular elements and connecting elements in a comparatively short amount of time using the modular system. However, it is generally also possible to form the axis using a suitable polygonal or angular, for example square, cross section.

In one embodiment, the positioning device can form at least one protrusion, said protrusion being formed so as to be able to be arranged at a respective lateral edge of the bodies to be connected and said protrusion being able to arranged at the connecting element in a symmetrical plane, which refers to two adjacent pins and the axis. Therefore, the protrusion can be formed at the connecting element so that two adjacent modular elements can abut against the protrusion via the corresponding lateral edge of the modular element. The protrusion, just like the axis, can prevent a shifting or undesired movement of the modular elements relative to one another, respectively, and thus ensure an improved arrangement of the modular elements. The protrusion can, for example, be formed in the shape of a protruding jut or a pyramid so that a tip of the protrusion can be placed between the modular elements or their lateral edges, respectively, whereby centering the modular elements becomes possible. In particular if the modular elements have measurements which deviate from one another, a constant relative positioning of the modular elements is enabled by the protrusion so that possible dimensional deviations are no longer readily identifiable.

Preferably, the protrusion can be formed in the shape of a crosspiece such that the adjacent body can be positioned or distanced, respectively, relative to one another. Centering the bodies or the modular elements, respectively, can be achieved particularly easily using a protrusion in the shape of a crosspiece, said protrusion in the shape of a crosspiece moreover being able to formed extending towards a progression of the lateral edges.

The component assembly can further comprise at least two connecting elements, said connecting elements being able to be arranged opposite one another at the connecting structure in such a manner that the axes and the pins align. If the connecting structure forms a through opening, not only a connecting element can be inserted into the through opening but also a second connecting element can be inserted from an opposite side of the through opening. For this purpose, it is essential that a length of the pins or the axes, respectively, is measured such that the pins and the axes can be entirely inserted into the through opening. The modular elements can thus be connected even more securely. In further embodiments of a connecting element, the pins and axes can also interlockingly mesh, for example via a locking connection.

Furthermore, a concentric through opening and/or a concentric void or a blind hole, respectively, can be formed in the axis and/or in the pins, a screw being able to be inserted into each opening and/or void or blind hole, respectively, for connecting the connecting elements. The connecting elements or rather pins or axes, which may be inserted in the connecting structure on the opposite side, can then be secured by a screw. In the case of a through opening, a bolt secured using a nut can be used or, alternatively, a self-drilling screw. The self-drilling screw in the pin can also be used in the type of a screw anchor such that the screw spreads the pin and a force-fit connection to the void is formed in the connecting structure. A positioning void can be provided at the connecting element for the nut, although a depression at the connecting element can be provided for the screw head as well. Furthermore, only the pins, the axes or both together can be used or formed, respectively, for forming a screw connection. Alternatively, it is also possible to use a dowel pin or stud instead of a screw in order to connect the connecting elements.

Advantageously, the connecting element can form connecting crosspieces or a connecting plate, which can connect the pins and the axis and form an abutting surface for the connecting structure. The connecting plate can, for example, be shaped circular or in a different geometric form, said pins and said axis being able to formed on a side of the connecting plate. If the connecting element is made of plastic, it can be produced particularly easily in large quantities. The pins can then, for example, be pushed so far into the void that the connecting plate abuts on a surface of the cupped body and thus forms the abutting surface for the connecting structure. Simultaneously, it is possible to use connecting crosspieces instead of a connecting plate for the same purpose, said connecting crosspieces connecting the pins and axes to one another. Thus, the connecting crosspieces can be arranged towards the pins in the shape of a star starting from a central axis.

In an alternative embodiment, the axis and the pins of the connecting element can be formed as individual components independent of one another, the arc-shaped contour then being formed as a recess in the corner such that the axis can at least partially be received in the void and be covered by the base sides of the body. The axis and the pins can thus be entirely separated from one another, said axis also being able to be formed as a type of disk. The void of the corner can comprise the shape of a circular sector or a circular segment so that the axis can be inserted into the void. The base sides of the body at least partially cover the axis so that the axis is received and supported between the base sides. This makes it possible to receive an entirely flat base side of a wall since the axis cannot jut over the body on the side of the base.

The axis can also comprise through openings, the pin being able to be interlockingly inserted into the through opening of the axis and the void of the connecting structure, said void aligning with the through opening. If the axis is inserted into the contour of the corner, the void of the connecting structure can align with the through opening of the axis so that the pin can be inserted into the through opening and interlockingly fix the axis in the void. The void of the connecting structure can thus be designed as a through bore. It can also be provided that the pins are connected amongst one another so that an installation is simplified.

In another alternative embodiment, the positioning device can comprise two axes, which are each allocated to a pin, said axes being able to be connected to one another by means of an at least partially flexible rod or truss. Two modular elements would no longer be required to use a shared axis for relative positioning. The rod or truss, respectively, can connect the pins and the corresponding axes to one another so that the modular elements, depending on the length of the rod, are distanced to one another. In particular, it is then possible to form a permeable structure made of modular elements. Preferably, the rod can be made of a plastic so that the rod is partially flexible. Such a flexible plastic material can then also be chosen so that tilting the bases of the box-shaped body relative to one another is enabled. Thus, further possibilities for forming structures are possible.

The connecting plate can be formed having a hinge, said hinge being able to enable moving modular elements connected to one another relative to one another. The hinge can be a hinge in the type of a door hinge or a simple living hinge if the connecting plate is made of a plastic material. It thus becomes possible to form a door made of modular elements, for example.

Preferably, the base can be rectangular or square and comprise at least four corners. In this instance, the connecting element can also comprise four pins in order to be able to connect four modular elements to its four corresponding corners. Nonetheless, it is possible that the connecting element is formed as one half or one quarter of a connecting element having two pins or one pin, respectively, if the connecting element is arranged at an edge section or a corner of a structure. Furthermore, the base can be an isosceles triangle, a pentagon or another suitable geometric shape.

The body of the modular element can be formed by the base and by frame walls peripherally surrounding the base, said frame walls being able to extend over only one base side of the base or over both base sides of the base. The frame walls can thus surround the base on all sides. If both base sides of the base comprise frame walls, they can each be the same height so that the modular elements can be installed independently to their base side.

Since the frame walls also essentially serve to stabilize the base of the body, it is advantageous if a height of the frame walls is formed at a ratio of 1:10, 1:5 or 1:1 to a width of the base. At a ratio of 1:1, the body can also be designed as a type of cube. As long as a height of the frame walls is approached to a width of the base, the void of the connecting structure can further be formed as a blind hole.

Supplementarily, the modular element can also comprise a lid wall, which can also be inserted into or at the cupped body parallel to the base in such a manner that an intermediate floor or a lid, respectively, of the modular element is formed. By inserting the lid wall, it is then possible to form a body closed on all sides. An internal space of the body can then, for example, be filled with any objects or materials. The lid wall can be formed so that it abuts against abutting surfaces formed at the frame walls and can also engage with the frame walls. The abutting surfaces can also be formed relative to the frame walls in such a manner that the lid wall forms an intermediate floor within the box-shaped body. An additional lid will can then also form a lid additionally to the intermediate floor. Any number of floors can then generally be formed within the box-shaped body, in dependence of a height of the frame wall. Thus, several layers of different fillings can be arranged behind one another within the modular element.

In a further embodiment, the lid can form protrusions and the frame walls can form voids, or vice versa, said protrusions being able to be inserted into the voids such that the protrusions and the voids form a hinge, which enables opening and closing the lid. By this means, accessing the internal space of the box-shaped body, said internal space being created by the lid, is immensely simplified. The modular elements can, for example, be used for storing objects, which require frequent access.

Furthermore, the connecting structure can be formed only on one base side, an opposite base side of the base being able to be formed continuously all the way to the corners. Consequently, it is possible to connect the modular elements to the connecting structures on only the base side by means of the connecting elements, the opposite base side being able to be realized entirely flat and closed since no connecting elements can be mounted here. The void of the connecting structure can also be formed as a blind bore.

The base can also comprise an opening, which extends over a significant portion of the base. The opening can comprise the same geometric shape as the base so that the base or rather the body forms a frame of the opening. Other elements of the module system, such as a lamp or a sound-deadening material, can thus also be inserted into the opening.

The appearance of a modular system product can be designed particularly appealingly if the modular element is at least partially and/or the connecting element is entirely made of a transparent, translucent or opaque plastic. Thus, the modular elements or the connecting elements, respectively, as well as further components of the modular system can be made of differently colored plastics. Simultaneously, it is possible to make certain components of the modular system of metal if necessary.

In order to be able to form spatial structures in a simplified manner, the modular element can be realized as a modular angular element, at least two connecting structures of the modular angular elements being able to be arranged relative to one another at an angle $\alpha$ larger than 0°, preferably 45° and particularly preferably 90°. Possible corners of the spatial structure can then be realized by the modular angular element. The modular angular element can comprise a base, which is evenly curved or angled along a line, for example. Various spatial deviations of the base are possible here.

In order to be able to design the modular system more variably, the component assembly can comprise an adaptation element, said adaptation element being able to be realized as being connected to the connecting structures of a modular element as well as being designed in the shape of a container. The adaptation element can be arranged at a wall made of modular elements and used for storing various objects. The design itself can also be box-shaped or funnel-shaped.

The modular system product according to the invention, in particular wall, lid, lamp or the like, is realized using a modular system according to the invention. Advantageous embodiments of a modular element product can be taken from the dependent claims referring back to claim 1.

BRIEF DESCRIPTION OF THE DRAWING FIGURES

In the following, different embodiments of the invention are further described under reference to the attached drawings.

In the figures,

FIG. 1 shows a perspective view of a wall, formed using a first embodiment of the modular system;

FIGS. 2*a* to 2*d* show different views of a first embodiment of a modular system;

FIG. 3 shows an enlarged view of four modular elements according to the first embodiment;

FIGS. 4*a* to 4*b* show different representations of a connecting element assembly in a first embodiment;

FIGS. 5*a* to 5*c* show different representations of a connecting element assembly in a second embodiment;

Figure 13A:
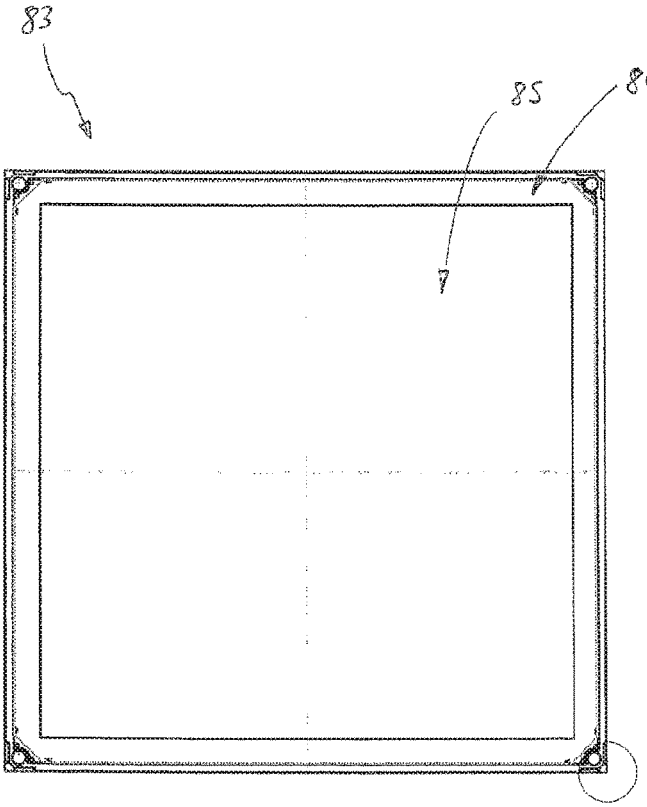
Figure 13B:
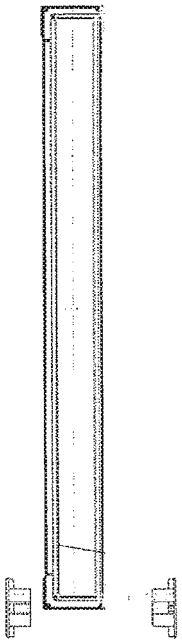
Figure 13C:
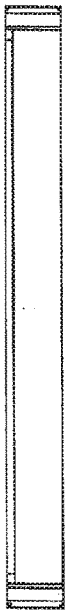
Figures 14A, 14B, 14C, 15A, 15B, 15C, 16:
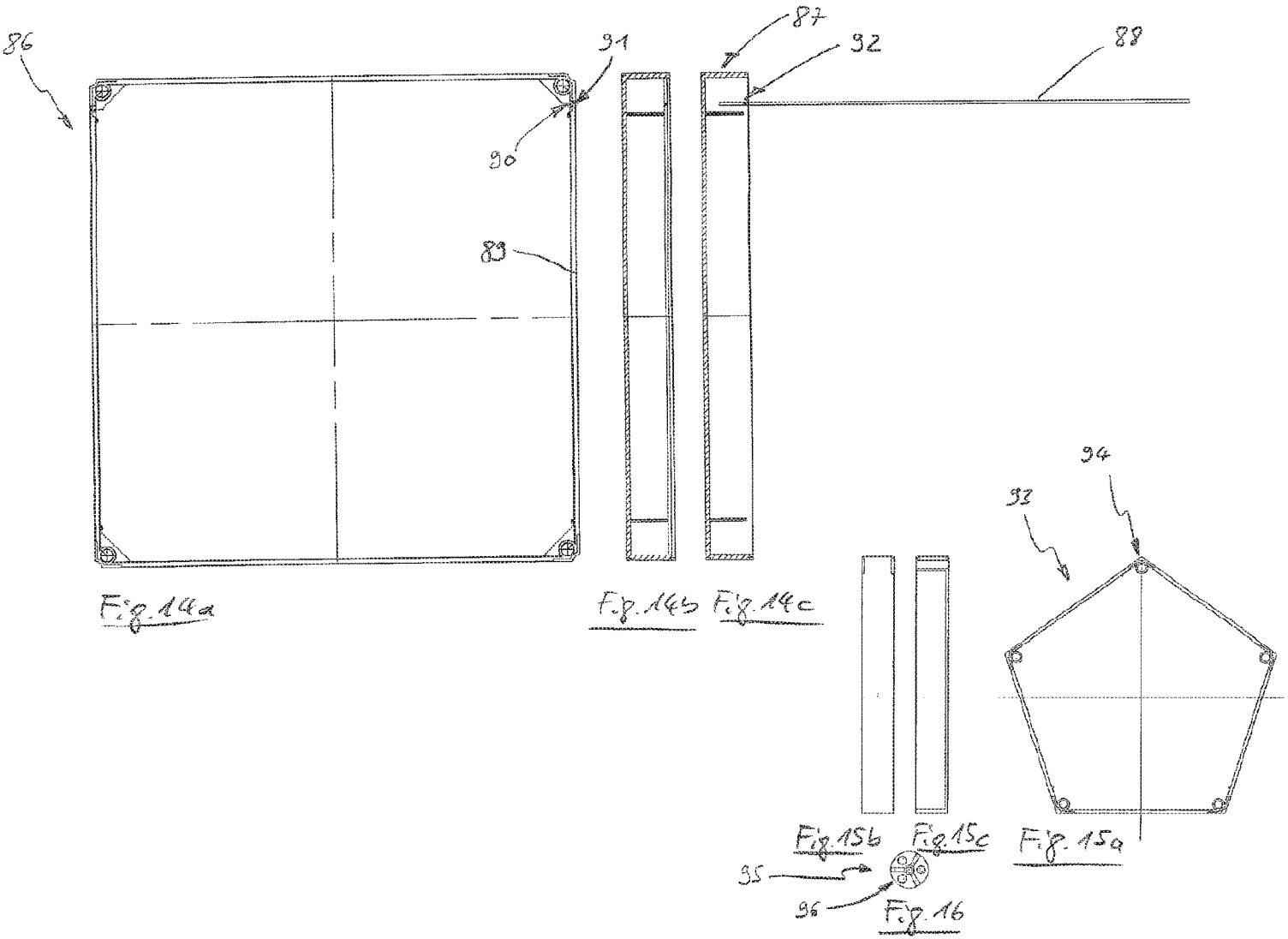
Figure 17:
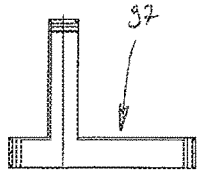
Figure 18:
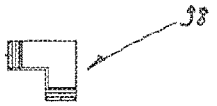
Figure 19:
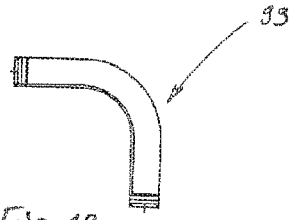
Figure 21:
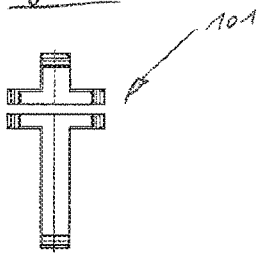
Figure 20:
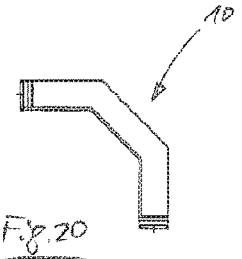
Figure 22:
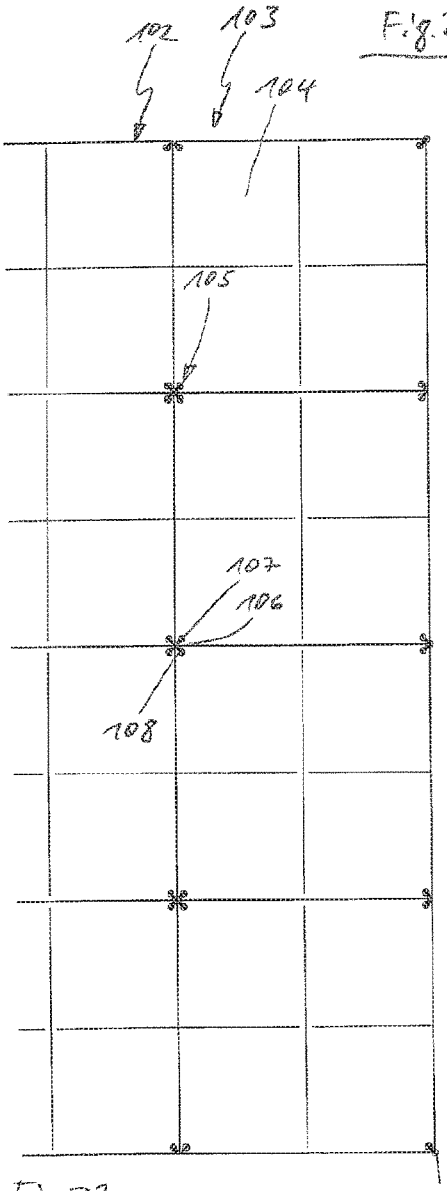
Figure 23:
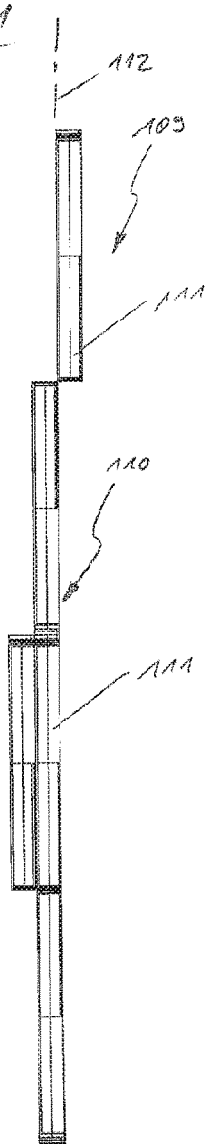
Figure 24:
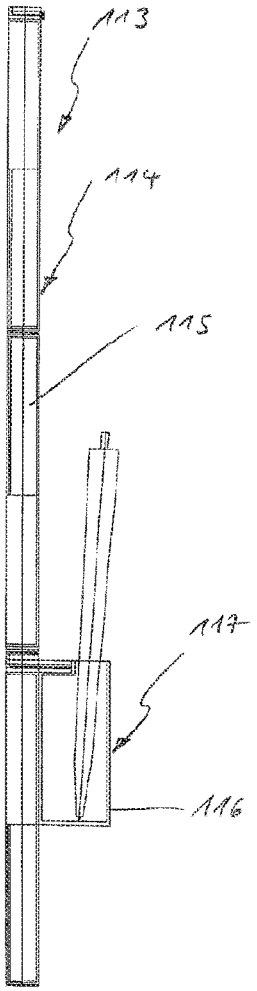
Figure 25:
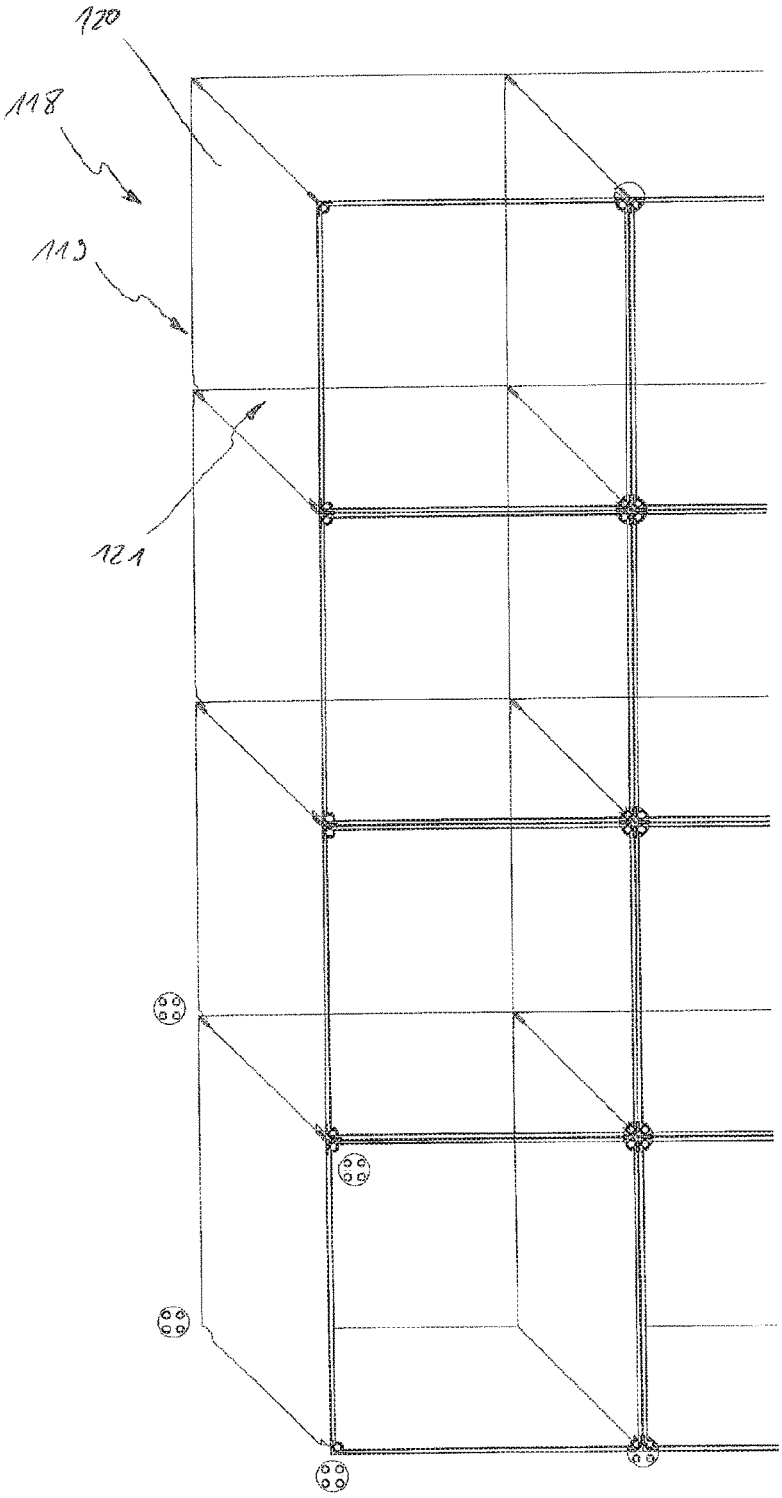
Figures 26A, 26B, 26C, 26D:
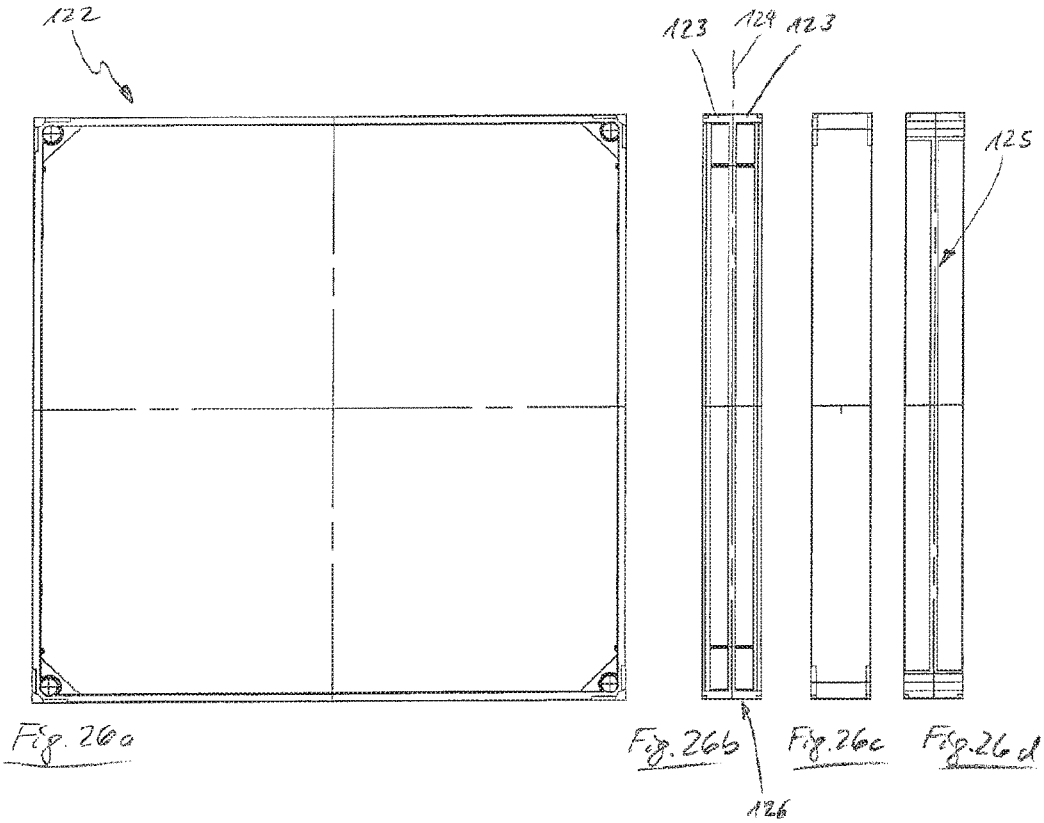
Figures 27A, 27B, 27C, 28, 29:
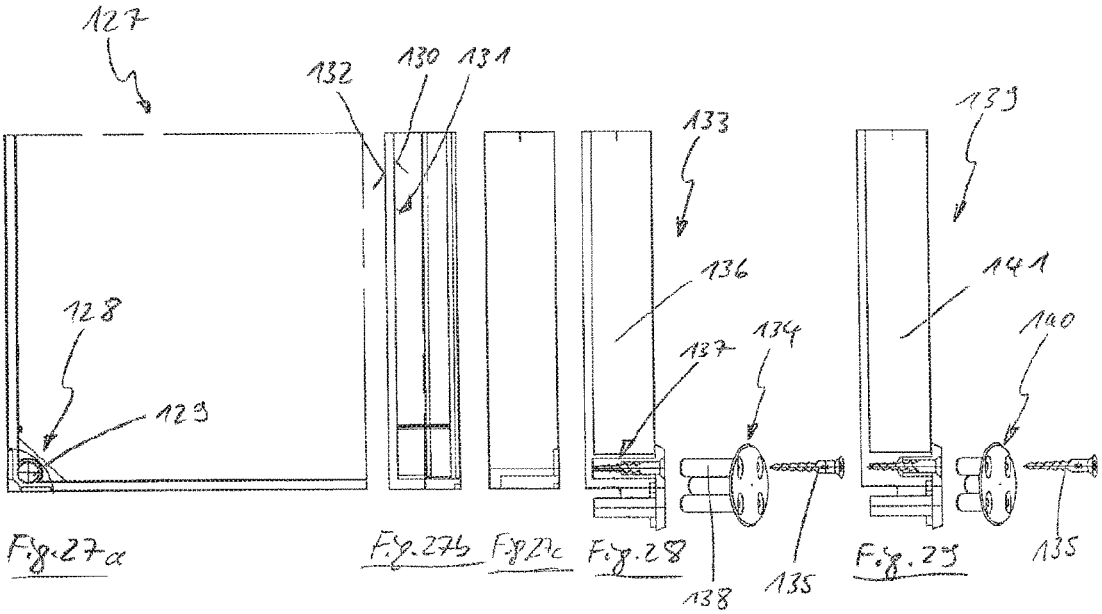
Figures 30A, 30B:
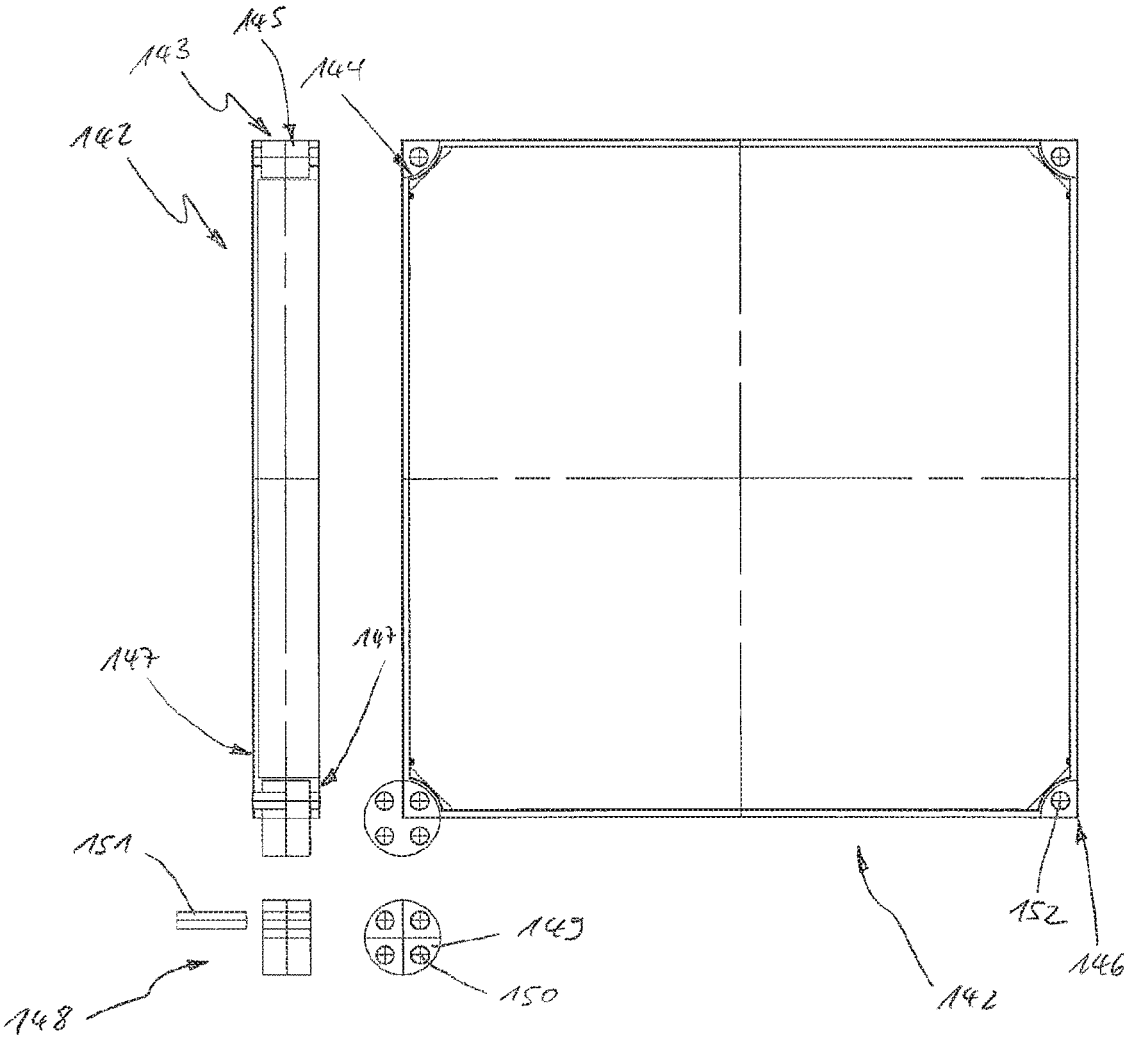
Figure 31:
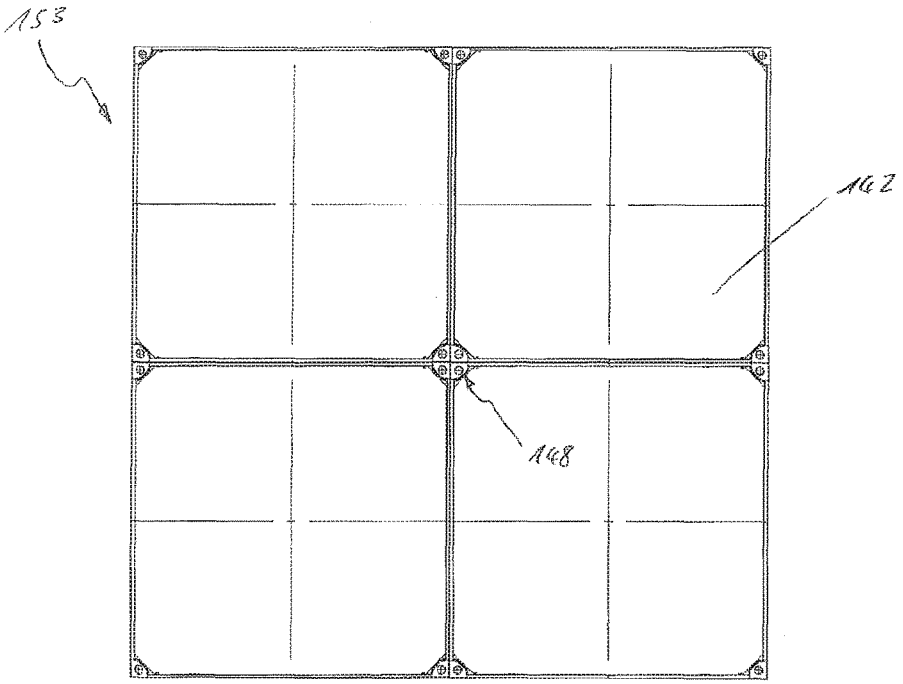
Figures 32A, 32B:
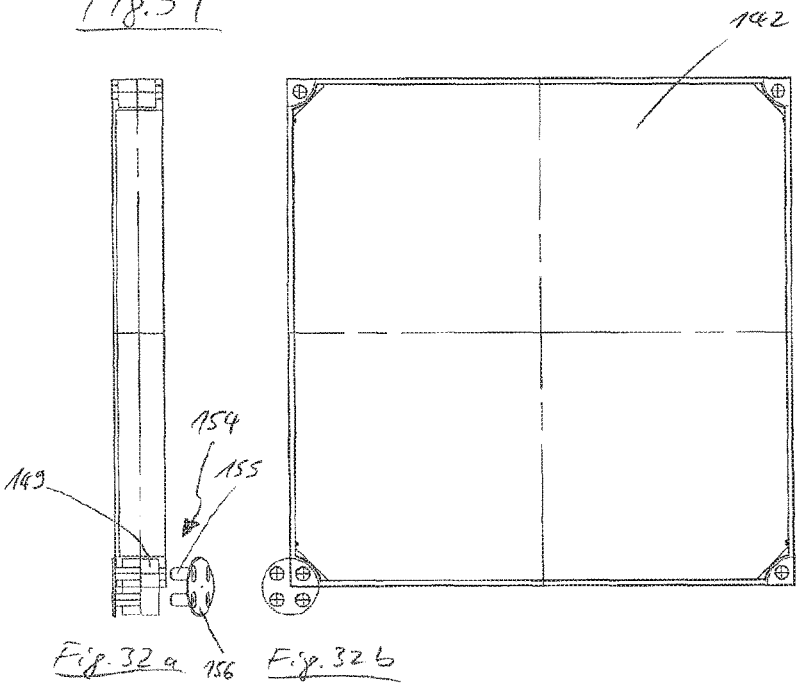

FIGS. 13*a* to 13*c* show a second embodiment of a modular element in different views;

FIGS. 14*a* to 14*c* show a third embodiment of a modular element in different views;

FIGS. 15*a* to 15*c* show a fourth embodiment of a modular element in different views;

FIG. 16 shows a representation of a connecting element assembly in a ninth embodiment;

FIG. 17 shows a fifth embodiment of a modular element;

FIG. 18 shows a sixth embodiment of a modular element;

FIG. 19 shows a seventh embodiment of a modular element;

FIG. 20 shows an eighth embodiment of a modular element;

FIG. 21 shows a ninth embodiment of a modular element;

FIG. 22 shows a front view of a wall formed using a third embodiment of a modular system;

FIG. 23 shows a lateral view of a wall formed using a fourth embodiment of a modular system;

FIG. 24 shows a lateral view of a wall formed using a fifth embodiment of a modular system;

FIG. 25 shows a front view of a shelf formed using a sixth embodiment of a modular system;

FIGS. 26*a* to 26*d* show a tenth embodiment of a modular element in different views;

FIGS. 27*a* to 27*c* show an eleventh embodiment of a modular element in different views;

FIG. 28 shows a sectional representation of a connecting element assembly in a tenth embodiment;

FIG. 29 shows a sectional representation of a connecting element assembly in an eleventh embodiment;

FIGS. 30*a* to 30*b* show a twelfth embodiment of a modular element in different views comprising a connecting element assembly in a twelfth embodiment;

FIG. 31 shows a front view of a wall formed using a seventh embodiment of the modular system;

FIGS. 32*a* to 32*b* show the twelfth embodiment of a modular element in different views comprising a connecting element assembly in a thirteenth embodiment.

DETAILED DESCRIPTION OF THE INVENTION

Figure 1:
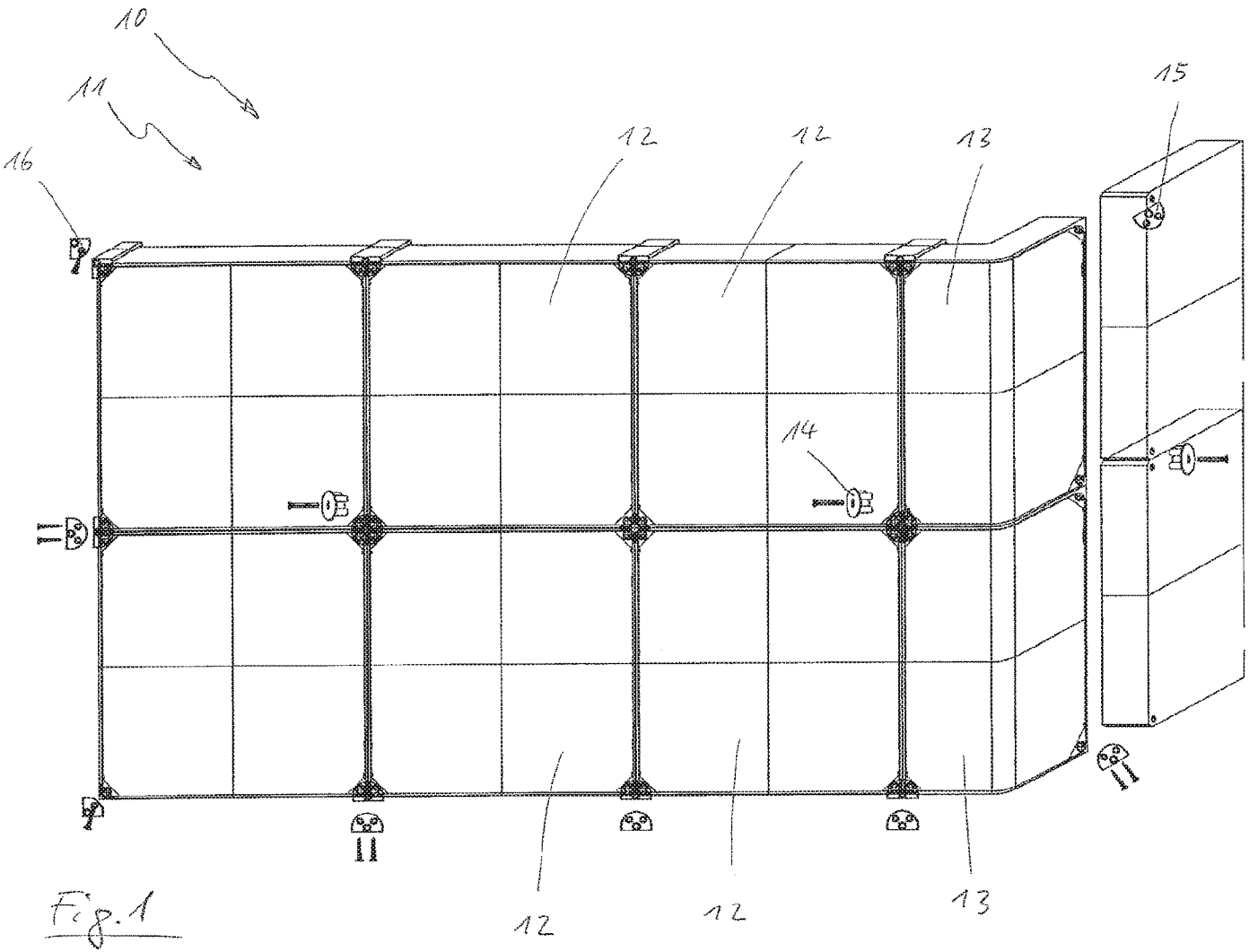
Figures 2A, 2B, 2C, 2D:
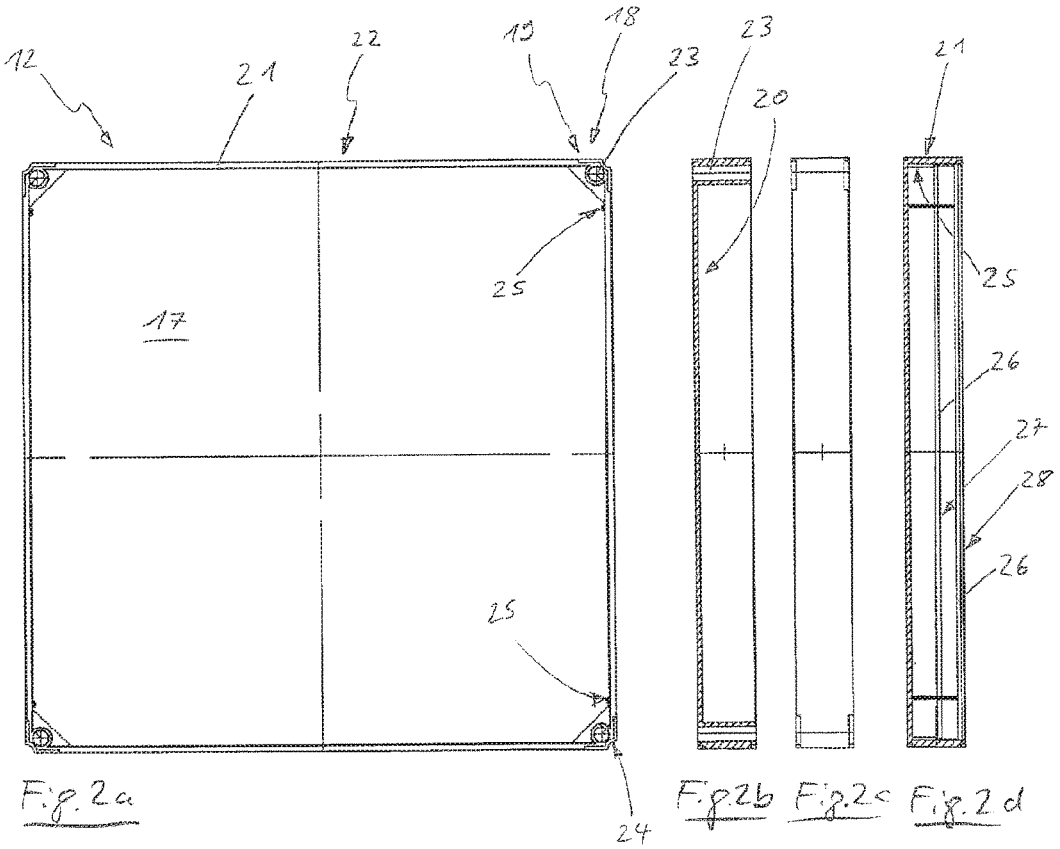
Figure 3:
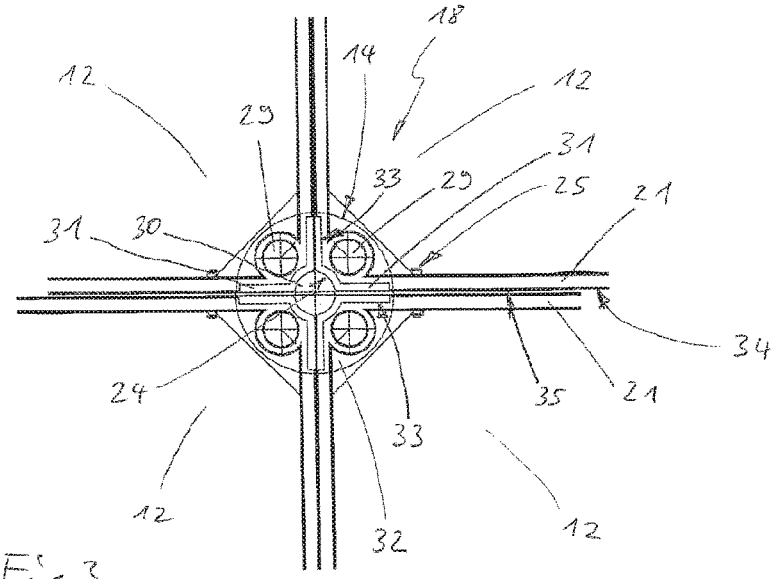

A synopsis of the FIGS. 1 to 3 shows a modular system 10, by means of which a wall 11 is formed. The modular system 10 comprises a plurality of modular elements 12 and modular angular element 13 as well as connecting elements 14, 15 and 16. The modular elements 12 comprise a square base 17, a connecting structure 19 being formed at each of its corners 18. Along base sides 20 of the base 17, frame walls 21 extend in such a manner that the base 17 is entirely surrounded by the frame walls 21 so that a box-shaped body 22 is formed.

The connecting structure 19 comprises a through opening 23 and an arc-shaped contour 24 of the corner 18. Furthermore, crosspieces 25 are formed at the frame walls 21, a lid wall 26 being able to be placed on said crosspieces 25 so that an intermediate floor 27 is formed. Using another lid wall 26, it is possible to form a lid 28 for the modular element 12 so that the box-shaped body 22 is closed on all sides.

As can be seen in the enlarged view in FIG. 3, four modular elements 12 can be interlockingly connected to one another by means of a connecting element 14. The connecting element 14 comprises four pins 29 and an axis 30, said pins 29 being able to be inserted into the through openings 23 and said axis 30 being adjusted to the contour 24. Moreover, the connecting element 14 forms four crosspiece-shaped protrusions 31, which are connected to one another in conjunction with the pins 29 and the axis 30 via a connecting plate 32 of the connecting element 14. The protrusions 31 rest against bevels 33 of the connecting structure 19 or at lateral edges 34 of the modular element 12, respectively, in such a manner that the modular elements 12 are positioned relative to one another at equal distances. Gaps 35 potentially arising between the modular elements 12 are adjusted to one another regarding their size.

Figure 4A:
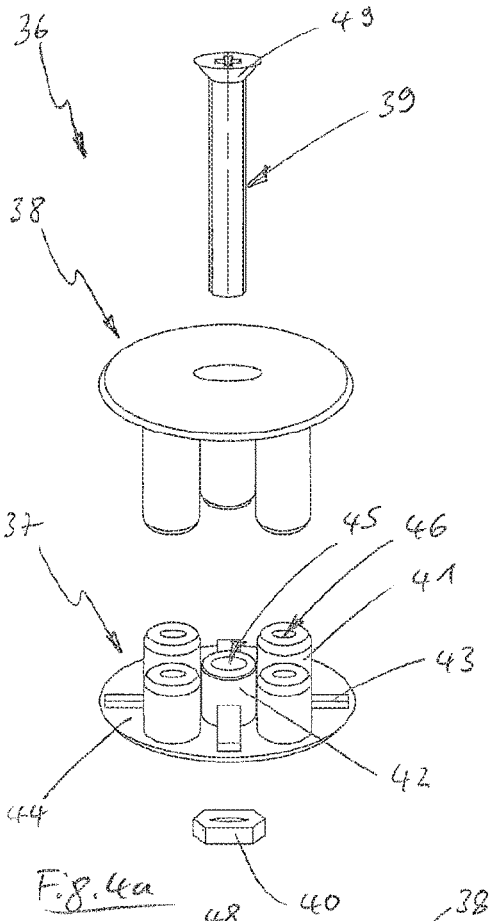
Figure 4B:
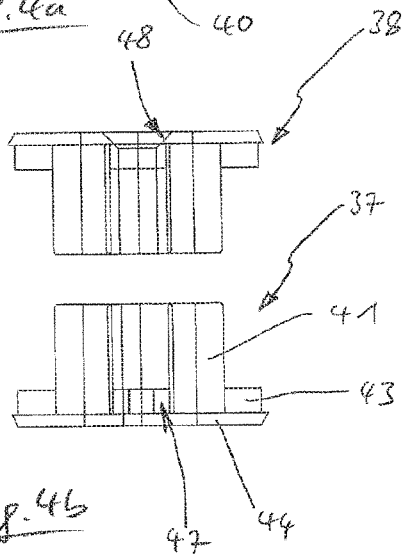

A synopsis of the FIGS. 4*a* to 4*b* shows a connecting element assembly 36, comprising connecting elements 37 and 38 as well as a bolt 39 comprising a nut 40. The connecting element 37 comprises pins 41 as well as an axis 42 and crosspiece-shaped protrusions 43, said protrusions 43 being connected to one another via a connecting plate 44. A through opening 45 is formed within the axis 42 and a blind hole 46 is formed in each pin 41. In the connecting element 37, moreover, a void 47 for receiving the nut 40 is formed, a depression 48 for receiving the bolt head 49 of the bolt 39 being formed in the connecting element 38. The bolt 39 can be inserted through both connecting elements 37 and 38 and screwed in place using the nut 40.

Figure 5A:
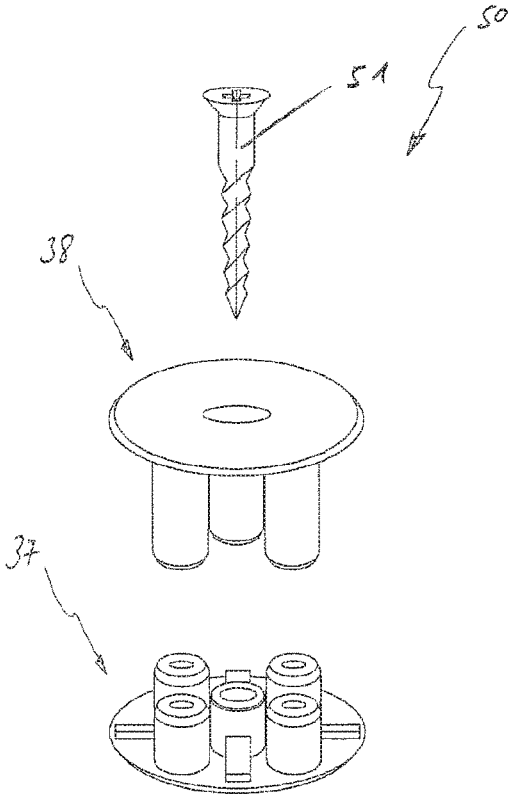
Figure 5B:
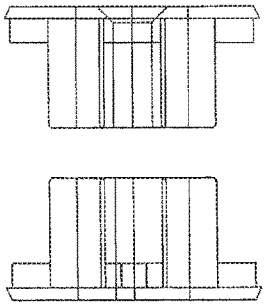
Figure 5C:
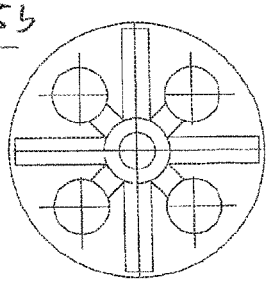

The FIGS. 5*a* to 5*c* show a connecting element assembly 50, which, in contrast to the connecting element assembly from FIGS. 4*a* to 4*b*, comprises a self-drilling screw 51. Using the self-drilling screws 51, the connecting elements 37 and 38 can be connected as commonly known.

Figure 6:
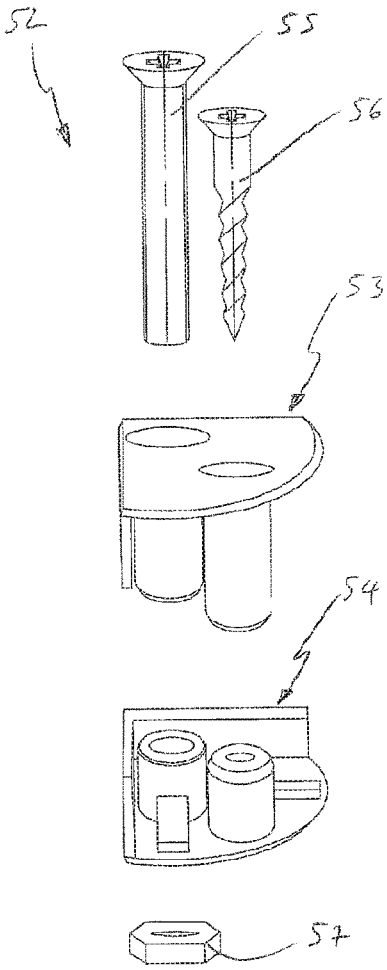
FIG. 6 shows a perspective representation of a connecting element assembly in a third embodiment.

FIG. 6 shows a connecting element assembly 52 comprising connecting elements 53 and 54, bolts 55 and screws 56 as well as a nut 57. The connecting elements 53 and 54 are shaped as a quadrant so that they can serve as an end of a corner of a modular element, said corner not shown here.

Figure 7:
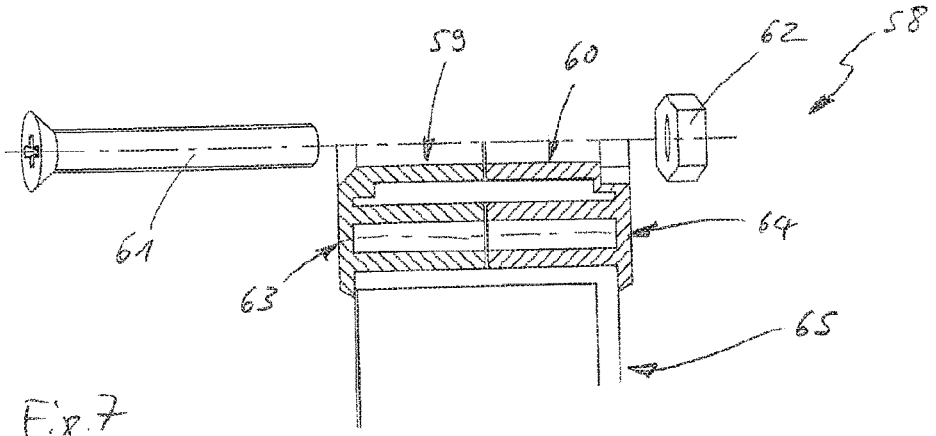
FIG. 7 shows a sectional representation of a connecting element assembly in a fourth embodiment.

FIG. 7 shows a sectional view of a connecting element assembly 58 comprising connecting elements 59 and 60, a bolt 61 and a nut 62. The connecting elements 59 and 60 each comprise connecting plates 63 and 64, respectively, which are realized such that a modular element 65 can be clamped between the connecting plates 63 and 64 by means of the bolt 61 and the nut 62.

Figure 8:
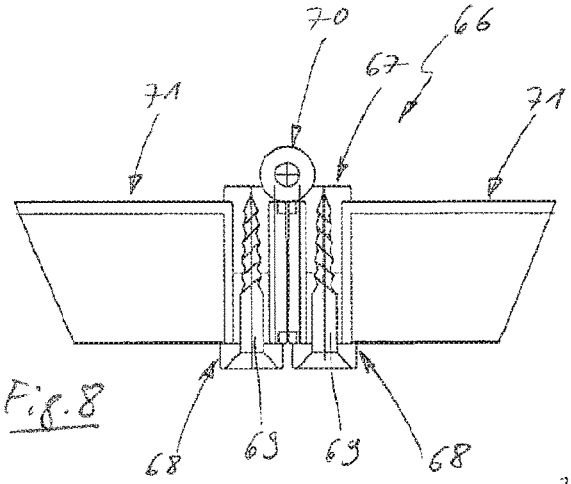
FIG. 8 shows a sectional representation of a connecting element assembly in a fifth embodiment.

FIG. 8 shows another sectional representation of a connecting element assembly 66 comprising connecting elements 67 and 68 as well as screws 69. In particular the connecting element 67 forms a hinge 70. Modular elements 71 are each clamped between the connecting elements 67 and 68.

Figure 9:
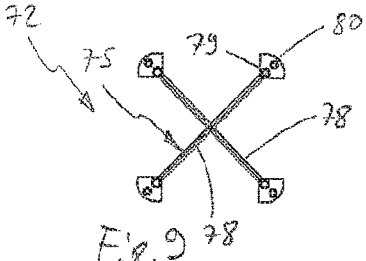
FIG. 9 shows a front view of a connecting element assembly in a sixth embodiment.
Figure 10:
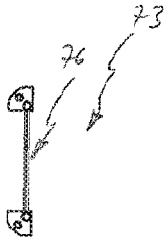
FIG. 10 shows a front view of a connecting element assembly in a seventh embodiment.
Figure 11:
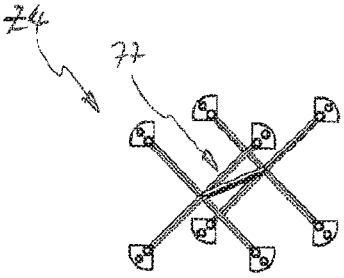
FIG. 11 shows a perspective representation of a connecting element assembly in an eighth embodiment.

FIGS. 9 to 11 each show different embodiments of connecting element assemblies 72, 73 and 74 and their connecting elements 75, 76 and 77, respectively. As can be seen in the example of the connecting element 75, rods 78 each always connect an axis 79 to a pin 80, which are formed for connecting to a connecting structure of a modular element not shown here. The rods consequently enable connecting the respective modular elements to one another at a defined distance, defined by the rods 78, to one another.

Figure 12:
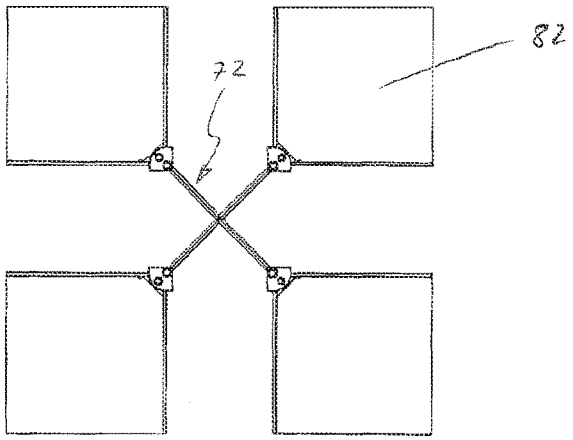
FIG. 12 shows a front view of a modular system in a second embodiment comprising the connecting element assembly according to the sixth embodiment.

FIG. 12 shows a modular system 81 comprising the connecting element assembly 72 from FIG. 9 as well as four modular elements 82, which are shown only in sections.

A synopsis of FIGS. 13*a* to 13*c* shows a modular element 83, which is generally realized like the modular element shown in FIGS. 2*a* to 2*d*, albeit comprising a square opening 85 in a base 84.

FIGS. 14*a* to 14*c* show a modular element 86 comprising a cupped body 87 and a lid 88. Voids 90 are formed in frame walls 89 of the modular element 86, protrusions 92, which are formed at the lid 88, being able to be engaged in said voids 90. Thus, a hinge 92 can be formed for the lid 88, said hinge 92 enabling opening and closing the lid 88.

FIGS. 15*a* and 15*c* show a modular element 93, which forms five corners 94.

Befittingly thereto, FIG. 16 shows a connecting element assembly 95 comprising a connecting element 96.

FIGS. 17 to 21 each show different embodiments of modular angular elements 97, 98, 99, 100 and 101.

FIG. 22 shows a wall 102, which is formed by a modular system 103 comprising modular elements 104 and connecting elements 105. In particular the connecting elements 105 do not comprise connecting plates. Axes 106 and pins 107 are connected to one another via crosspieces 108.

FIG. 23 shows another modular system 109, by means of which a wall 110 is formed, modular elements 111 being connected to one another in a displaced manner or arranged on top of one another, respectively, relative to a wall plane 112.

FIG. 24 shows a modular system 113, by means of which a wall 114 is formed, an adapting element 116 being mounted on modular elements 115. The adapting element 116 is formed as a container 117 for receiving office supplies.

FIG. 25 shows a modular system 118, which forms a shelf 119. Modular elements 120 are essentially shaped like an open cube 121.

A synopsis of FIGS. 26*a* to 26*d* shows a modular element 83, which is made of two congruent modular element halves 123. The modular element halves 123 abut against one another in a middle plane 124 and together form a base 125 and a middle frame wall 126.

A synopsis of FIGS. 27*a* to 27*c* shows a modular element 127, whose connecting structure 128 or blind bore 129, respectively, is formed only on one side of a base side 130 of a base 131. An opposite base side 132 is entirely closed and formed flat.

FIG. 28 shows a sectional view of a connecting element assembly 133 comprising a connecting element 134 and a self-drilling screw 135 as well as a modular element 136. A blind bore 137 is formed in the modular element 136, a pin 138 of the connecting element 134 being able to be inserted in said blind bore 137. The pin can be spread like a screw anchor by means of the screw 135.

FIG. 29 shows a sectional view of a connecting element assembly 139 comprising a connecting element 140, although, in contrast to the connecting element assembly from FIG. 28, a modular element 141 comprises a shortened blind bore so that the screw 135 can be screwed into a material of the modular element 141.

A synopsis of FIGS. 30*a* to 30*b* shows a modular element 142 having a connecting structure 143, in which the arc-shaped contour 144 forms a void 145 in a corner 146 of the modular element 142. The void 145 is limited by base sides 147 of the modular element 142. A connecting element assembly 148 is formed in several pieces and comprises a disk-shaped axis 149 comprising through openings 150 as well as a number of pins 151 corresponding to the number of through openings 150. The axis 149 can be inserted into the void 145 so that the axis 149 is at least partially covered by the base sides 147 and can be received in the void 145. Through openings 152 are also formed in the base sides 147, said through openings 152 aligning with the through openings 150 of the axis 149. A pin 151 can thus be inserted through the through openings 152 and 150 and the axis 149 can be interlockingly mounted to the modular element 142.

FIG. 31 shows a front view of a wall 153 made of modular elements 142 comprising connecting elements 148.

A synopsis of FIGS. 32*a* to 32*b* shows the modular element 142 comprising a connecting element 154. The connecting element 154 is formed in several pieces and comprises the axis 149 and pins 155, which are connected to one another via a round connecting plate 156. A length of the pins 155 is measured such that two sets of pins 155 can be inserted opposite one another into the modular element 142 or the axis 149, respectively, in conjunction with the connecting plate 156.

The invention claimed is:

1. A modular system (10, 81, 103, 109, 113, 118) for structuring or designing spaces or surfaces, comprising a component assembly, comprising at least two modular elements (12, 13, 65, 71, 82, 83, 86, 93, 97, 98, 99, 100, 101, 104, 111, 115, 120, 122, 127, 136, 141, 142) and at least two connecting elements (14, 15, 16, 37, 38, 53, 54, 59, 60, 67, 68, 75, 76, 77, 96, 105, 134, 140, 148, 154), said modular element being designed as a box-shaped body (22, 87), whose base (17, 84, 125, 131) comprises at least three corners (18, 94, 146), each corner forming a connecting structure (19, 128) for connecting the modular element to the connecting elements, the connecting structure having an arc-shaped contour (24, 144) of the corner in conjunction with a void (23, 129, 137, 152) adjacent to the contour, each connecting element comprising a pin (29, 41, 80, 107, 138, 151, 155) for the connecting structures to be connected, said pin being congruent with the void for being interlockingly inserted into the void, each said connecting element forming a positioning device for positioning the connecting element at the modular element, said positioning device comprising an axis (30, 42, 79, 106, 149), said axis being congruent with the contour for being arranged at said contour, said at least two connecting elements arranged opposite one another at the connecting structure in such a manner that the axes (30, 42, 79, 106) and pins (29, 41, 80, 107, 138, 151, 155) align.

2. The modular system according to claim 1, characterized in that the positioning device forms at least one protrusion (31, 43), said protrusion being formed to be arranged at a respective lateral edge (34) of two bodies (22, 87) to be connected, said protrusion being able to arranged at each connecting element (14, 15, 16, 37, 38, 53, 54, 59, 60, 67, 68, 75, 76, 77, 96, 105, 134, 140, 148, 154) in a symmetrical plane, which refers to two adjacent pins (29, 41, 80, 107, 138, 151, 155) and the axis (30, 42, 79, 106, 149).

3. The modular system according to claim 2, characterized in that the protrusion (31, 43) is shaped like a crosspiece in such a manner that the adjacent bodies (22, 87) can be positioned relative to one another.

4. The modular system according to claim 3, characterized in that each connecting element (14, 15, 16, 37, 38, 53, 54, 59, 60, 67, 68, 75, 76, 77, 96, 105, 134, 140, 148, 154) forms connecting crosspieces (108) or a connecting plate (32, 44, 63, 64, 156), which connects the pins (29, 41, 80, 107, 138, 155) and the axis (30, 42, 79, 106) and forms an abutting surface for the connecting structure.

5. The modular system according to claim 4, characterized in that the connecting plate is designed comprising a hinge (70), which enables moving modular elements (12, 13, 65, 71, 82, 83, 86, 93, 97, 98, 99, 100, 101, 104, 111, 115, 120, 122, 127, 136, 141) relative to one another.

6. The modular system according to claim 1, characterized in that a concentric through opening (45) and/or a concentric void (46) are formed in the axis (30, 42, 79, 106, 149) and/or in the pins (29, 41, 80, 107, 138, 151, 155), a screw (39, 51, 55, 56, 61, 69, 135) for connecting the at least two connecting elements (14, 15, 16, 37, 38, 53, 54, 59, 60, 67, 68, 75, 76, 77, 96, 105, 134, 140, 154) being able to be inserted into the through opening and the void, respectively.

7. The modular system according to claim 1, characterized in that the axis (149) and the pins (151, 155) of the connecting element are individual components, the arc-shaped contour (144) being formed as a void (145) in the corner (146) such that the axis can be at least partially received in the void and be covered by the base sides (147) of the body.

8. The modular system according to claim 7, characterized in that the axis (149) comprises through openings (150), the pin (151, 155) being able to be interlockingly inserted into the through opening of the axis and into the void (152) of the connecting structure (143), said void (152) aligning with the through opening.

9. The modular system according to claim 1, characterized in that the positioning device comprises two axes (79), which are each allocated to a pin (80), said axes being connected to one another by means of a partially flexible rod (78) or a truss.

10. The modular system according to claim 1, characterized in that the base (17, 84, 125, 131) is rectangular or square and comprises at least four corners (18, 94, 146), the modular element (12, 13, 65, 71, 82, 83, 86, 93, 97, 98, 99, 100, 101, 104, 111, 115, 120, 122, 127, 136, 141, 142), at least partially, and/or the connecting elements (14, 15, 16, 37, 38, 53, 54, 59, 60, 67, 68, 75, 76, 77, 96, 105, 134, 140, 148, 154) being made of a transparent, translucent or opaque plastic.

11. The modular system according to claim 1, characterized in that the body (22, 87) is formed by the base (17, 84, 125, 131) and frame walls (21, 89, 126) peripherally surrounding the base, said frame walls extending on only one base side (20, 147) of the base or on both base sides (130, 132) of the base.

12. The modular system according to claim 11, characterized in that a height of the frame wall (21, 89, 126) is formed at a ratio of 1:10, 1:5 or 1:1 to a width of the base (17, 84, 125, 131).

13. The modular system according to claim 11, characterized in that the modular element (12, 13, 65, 71, 82, 83, 86, 93, 97, 98, 99, 100, 101, 104, 111, 115, 120, 122, 127, 136, 141, 142) comprises a lid wall (26), which can be inserted in or at a cupped body (22, 87) parallel to the base (17, 84, 125, 131) in such a manner that an intermediate floor (27) or a lid (28, 88) of the modular element, respectively, is formed.

14. The modular system according to claim 13, characterized in that the lid (88) forms protrusions (91) and the frame walls (89) form voids (90), and vice versa, said protrusions being able to be inserted into the voids in such a manner that the protrusions and the voids form a hinge (92), which enables opening and closing the lid (88).

15. The modular system according to claim 1, characterized in that the connecting structure (128) is formed on only one base side (130, 132) of the base and an oppositely arranged base side (147) of the base is formed uninterruptedly all the way to the corners (18, 94, 146).

16. The modular system according to claim 1, characterized in that the base (84) comprises an opening (85), which extends across a significant portion of the base.

17. The modular system according to claim 1, characterized in that the modular element is formed as a modular angular element (13, 97, 98, 99, 100, 101), at least two connecting structures of the modular angular element being arranged relative to one another at an angle of $\alpha>0°$.

18. The modular system according to claim 1, characterized in that the component assembly comprises an adapting element (116), said adapting element being formed so as to be able to be connected to the connecting structures of a modular element (12, 13, 65, 71, 82, 83, 86, 93, 97, 98, 99, 100, 101, 104, 111, 115, 120, 122, 127, 136, 141, 142) and forming a container-like shape (117).

19. A modular system product formed using the modular system (10, 81, 103, 109, 113, 118) according to claim 1.

20. The modular system according to claim 1, characterized in that the modular element is formed as a modular angular element (13, 97, 98, 99, 100, 101), at least two connecting structures of the modular angular element being arranged relative to one another at an angle of 45°-90°.

* * * * *